United States Patent [19]

Kageyama

[11] Patent Number: 4,619,539

[45] Date of Patent: Oct. 28, 1986

[54] MECHANICAL PENCIL EQUIPPED WITH LEAD-STORING CARTRIDGE

[75] Inventor: Hidehei Kageyama, Kawagoe, Japan

[73] Assignee: Kotobuki & Co, Ltd., Kyoto, Japan

[21] Appl. No.: 640,992

[22] Filed: Aug. 14, 1984

[30] Foreign Application Priority Data

Feb. 13, 1984 [JP] Japan ..... 59-17501[U]
Feb. 13, 1984 [JP] Japan ..... 59-17502[U]

[51] Int. Cl.[4] ..... B43K 21/00
[52] U.S. Cl. ..... 401/85; 401/65
[58] Field of Search ..... 401/53, 54, 65, 67, 401/78, 94, 214, 85, 89, 57, 90

[56] References Cited

U.S. PATENT DOCUMENTS 3,917,418 11/1975 Lanoie ..... 401/54 X
4,167,350 9/1979 Harris ..... 401/54 X
4,371,277 2/1983 Kageyama ..... 401/65

FOREIGN PATENT DOCUMENTS 812891 9/1951 Fed. Rep. of Germany ..... 401/65
2724317 12/1978 Fed. Rep. of Germany ..... 401/85
555350 5/1978 Japan ..... 401/67
83/00309 3/1983 PCT Int'l Appl. ..... 401/85

*Primary Examiner*—Richard J. Apley
*Assistant Examiner*—Robert W. Bahr
*Attorney, Agent, or Firm*—Sherman & Shalloway

[57] ABSTRACT

A mechanical pencil is constructed of (a) a decorative barrel to be held by a user; (b) a lead-feeding mechanism disposed within the decorative barrel; (c) a lead guide connected to the lead-feeding mechanism; and (d) a lead-containing cartridge having an outer diameter substantially equal to the inner diameter of the decorative barrel and held detachably in the decorative barrel. The mechanical pencil according to the present invention can be continuously used by simply replacing a used-up cartridge with a fresh cartridge containing a plurality of writing leads. Thus, it is unnecessary, different from conventional mechanical pencils, to insert a fresh supply of writing leads one by one into the mechanical pencil. Since a user is not required to touch writing leads directly, his hands are not smeared.

2 Claims, 17 Drawing Figures

FIG. 9(A)
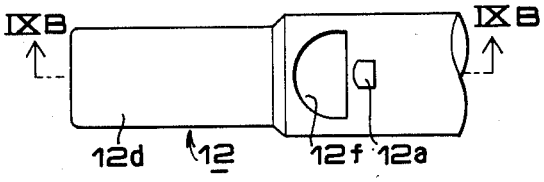
FIG. 9(B)
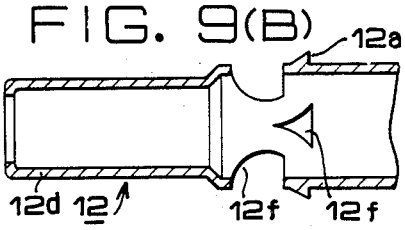
FIG. 10(A)
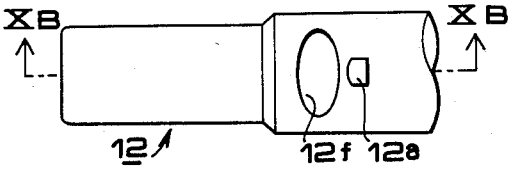
FIG. 10(B)
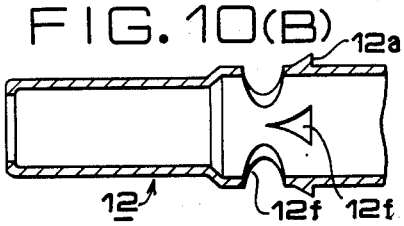
FIG. 11(A)
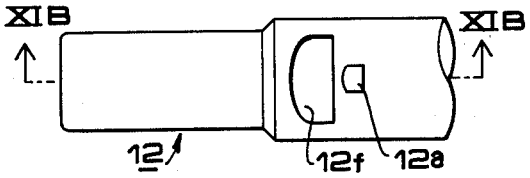
FIG. 11(B)
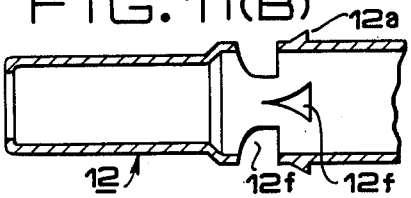
FIG. 12(A)
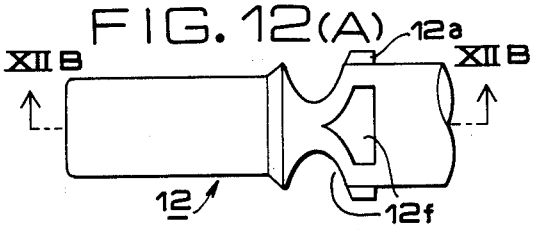
FIG. 12(B)
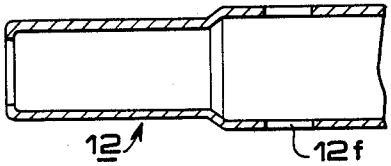
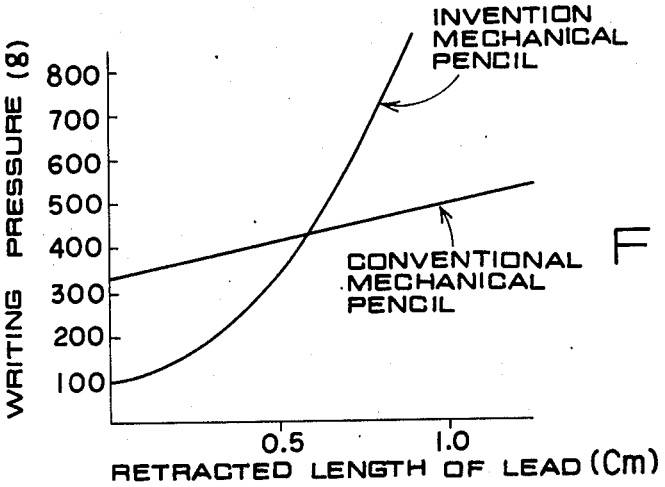
FIG. 13

MECHANICAL PENCIL EQUIPPED WITH LEAD-STORING CARTRIDGE

BACKGROUND OF THE INVENTION

1. Field of the Invention

This invention relates to a mechanical pencil, and more particularly to a mechanical pencil equipped with a writing lead storing cartridge which also serves as a tubular lead guide as a whole.

2. Description of the Prior Art

Conventional mechanical pencils are accompanied by such drawbacks that when a reserve supply of lead segments or rods, which may hereinafter be called "leads" for the sake of brevity, has been used up, a user is required to take out a fresh supply of leads from a lead case purchased beforehand and reserved for exclusive use in his mechanical pencil and to insert them one by one into the tubular lead guide of his mechanical pencil, namely, he is required to take such a cumbersome trouble and his hands may be smeared during the refilling work.

SUMMARY OF THE INVENTION

The principal object of this invention is to provide a useful mechanical pencil which has solved the above-mentioned drawbacks of conventional mechanical pencils.

Another object of this invention is to provide a mechanical pencil permitting easy refilling of fresh leads when a reserve supply of leads has been used up.

A further object of this invention is to provide a mechanical pencil having a simple structure formed of an extremely small number of parts.

A still further object of this invention is to provide a mechanical pencil which, even if one or more leads are still left in a decorative barrel or inner tube upon inserting a fresh cartridge, permits smooth entry of such left-over leads into the cartridge without breakage, blockage or the like of both of the left-over leads and freshly-filled leads.

A still further object of this invention is to provide a mechanical pencil having a cushioning portion in its inner tube, whereby to permit suitable control of writing pressures without failure.

Other objects and features of this invention will become more apparent from the following description of certain embodiments, taken in conjunction with the accompanying drawings.

BRIEF DESCRIPTION OF THE DRAWINGS

FIGS. 9A, 10A, 11A and 12A are respectively plan views of cushioning portions of inner tubes;

FIGS. 9B, 10B, 11B and 12B are longitudinal cross-sectional views taken respectively along lines IX-B—IXB, XB—XB, XIB—XIB and XIIB—XIIB of FIGS. 9A, 10A, 11A and 12A; and FIG. 13 is a graphic representation illustrating the relationship between retracted lengths of a lead and writing pressures.

PREFERRED EMBODIMENTS OF THIS INVENTION

Figure 1:
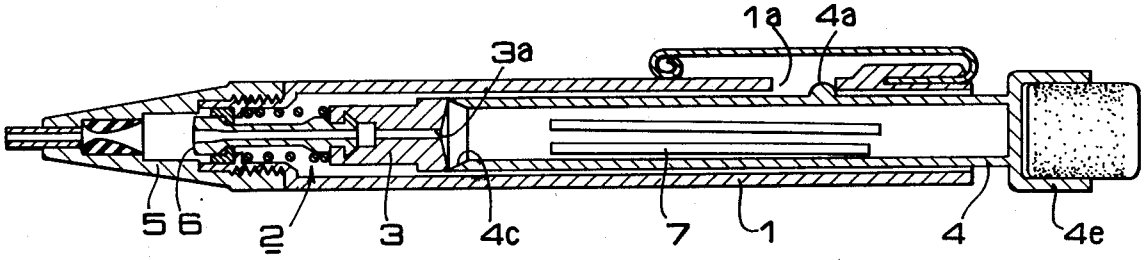
FIG. 1 is a longitudinal cross-sectional view of a mechanical pencil according to one embodiment of this invention.

As illustrated in the vertical cross-sectional view of FIG. 1, there are arranged within a decorative barrel 1 a lead-feeding mechanism 2, a lead guide connected to the lead-feeding mechanism 2, and a cartridge 4 detachably secured with the decorative barrel 1.

Figure 2:
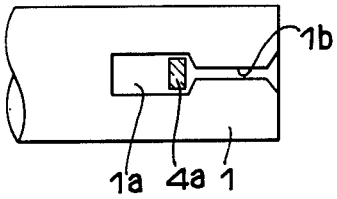
FIG. 2 is a plan view of an interlocking slot formed in a decorative barrel of the mechanical pencil of FIG. 1.

A conical tip 5 is detachably threaded on a tip portion of the decorative barrel 1. Through a portion of the circumferential wall of the decorative barrel 1, there is formed an interlocking slot 1*a* kept in engagement with a protrusion 4*a* of the cartridge so as to hold the cartridge 4 in place. This interlocking slot 1*a* may be formed, for example, in communication with a slit 1*b* extending frontwards from the rear end of the decorative barrel 1 as depicted in FIG. 2, whereby holding with ease the protrusion 4*a* of the cartridge 4 in place without failure.

Figure 3:
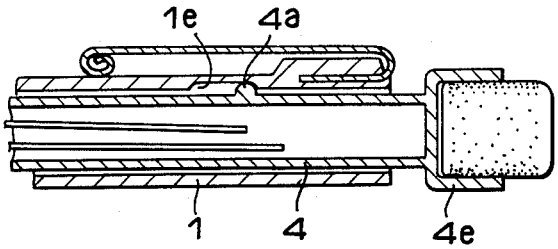
FIG. 3 is a fragmentary, longitudinal cross-sectional view of a mechanical pencil according to another embodiment of this invention.

FIG. 3 illustrates another embodiment of the interlocking means for the cartridge 4 and decorative barrel 1, in which an interlocking groove 1*e* is formed in the inner wall of the decorative barrel 1 to hold the protrusion 4*a* of the cartridge 4 detachably.

Figure 4:
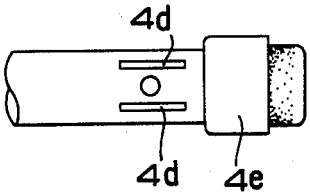
FIGS. 4 and 5 are respectively fragmentary plan views of cartridges of mechanical pencils according to further embodiments of this invention.
Figure 5:
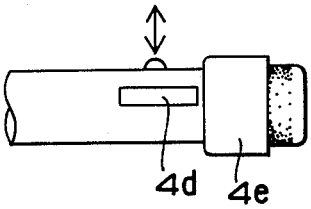

The cartridge shown in FIG. 4 is similar to that depicted in FIG. 3 except that slits 4*d* are formed through the circumferential wall of the cartridge 4 at locations near the protrusion 4*a*. FIG. 5 illustrates a similar cartridge to that shown in FIG. 4 except that only one slit 4*d*, which is broader than the slits 4*d* in FIG. 4, is formed adjacent to the protrusion through the circumferential wall of the cartridge 4. Owing to the slit 4*d*, the protrusion 4*a* can be bent radially (in the direction indicated by an arrow in FIG. 5) and can thus be brought with ease into engagement with the interlocking groove 1*e* of the decorative barrel 1 without failure. By the way, the detachable interlocking between the cartridge 4 and decorative barrel 1 may be established, besides the above-described embodiment, by the press-fitting or punching technique or by way of other interlocking members. In the above embodiments, the conical tip 5 and decorative barrel 1 are formed as separate members. They may however be formed as an integral parts.

The lead guide 3 is fit in the rear end of a lead chuck 6 of the lead-feeding mechanism 2. This lead guide 3 serves to feed writing leads 7 one by one to the lead chuck 6 and defines internally a lead-feeding bore 3*a* through which only one lead 7 may be fed out at once. The outer diameter of the rear end of the lead guide 3 is formed into substantially the same diameter as the inner diameter of the decorative barrel 1 so that none of the leads 7 is allowed to travel along the circumferential wall of the lead guide 3 to the side of the lead-feeding mechanism 2.

Furthermore, the cartridge 4 has, at the rear end thereof, a rear end cap 4*e* formed integrally therewith. The cartridge 4 stores a number of writing leads 7 therein and is generally sold with refilling writing leads already placed therein. The outer diameter of the cartridge 4 is formed into substantially the same size as the inner diameter of the decorative barrel 1. Preferably, the cartridge 4 defines at its forward end portion a tapered circumferential edge 4*c* for the guidance of leads. In addition, a protrusion 4*a* adapted to engage with the interlocking slot 1*a* of the decorative barrel 1 is formed on an area of the circumferential wall of the cartridge 4.

The operation and advantages of the mechanical pencil according to each of the above-described embodiments will next be described.

When the mechanical pensile has run out of leads in the course of its use, the cartridge 4 is withdrawn from the decorative barrel 1 by pulling it outwardly at the rear end cap 4*e*. Then, a fresh cartridge 4 containing leads 7 is pushed into the decorative barrel 1. The protrusion 4*a* of the cartridge 4 is brought into engagement with the interlocking slot 1*a* of the decorative barrel 1, thereby interlocking the fresh cartridge 4 and decorative barrel 1 together. Since the outer diameter of the cartridge 4 is substantially the same as the inner diameter of the decorative barrel 1, one or more leads which may have been left over in the decorative barrel 1 can be smoothly received within the fresh cartridge 4 without breakage or blockage. Where the tapered circumferential edge 4*c* is formed at the forward extremity of the cartridge 4, such a remaining lead or leads may be guided without failure into the cartridge 4 even if the remaining lead or leads lies or lie aslant in the decorative barrel 1. Once the cartridge 4 as a lead container has been directly disposed in and interlocked with the decorative barrel 1, it also serves as an elongated, tubular, lead guide. Therefore, the present invention can provide a mechanical pencil having a simple structure formed of an extremely small number of parts.

Other embodiments of this invention will next be described.

Figure 6:
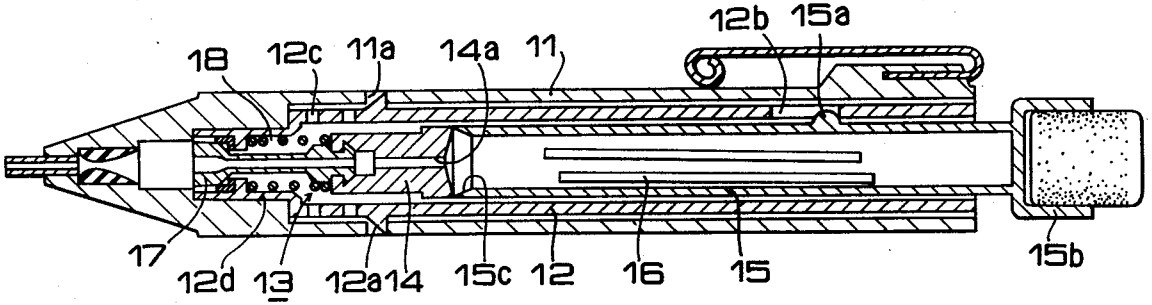
FIG. 6 is a longitudinal cross-sectional view of a mechanical pencil according to a still further embodiment of this invention.

As illustrated in the longitudinal cross-sectional view of FIG. 6, there are arranged, within an inner tube 12 which is in turn disposed within and interlocked with a decorative barrel 11, a lead-feeding mechanism 13, a lead guide 14 connected to the lead-feeding mechanism 13, and a cartridge 15 detachably interlocked with the inner tube 12.

A stopper slot 11*a* is formed through a portion of the circumferential wall of the decorative barrel 11, which stopper slot 11*a* is kept in engagement with a protrusion 12 of the inner tube 12 so as to hold the inner tube 12. By the way, the interlocking between the decorative barrel 11 and inner tube 12 may be established, besides the above embodiment, by the press-fitting or punching technique or by other interlocking members. In the illustrated embodiment, a conical tip and the decorative barrel 11 are formed into a unitary parts. They may however be formed as separate parts.

In the illustrated embodiment, the inner tube 12 is formed of a deformable material, for example, Duracon or another resilient material. At a rear part of the inner tube 12, there is formed an interlocking slot 12*b* for holding the cartridge 15. A cushioning portion 12*c* is on the other hand provided in the vicinity of the protrusion 12 at a front part of the inner tube 12. The cushioning portion 12 terminates continuously and forwardly in a sleeve portion 12*d* which serves as a sleeve.

A slit may for example be formed continuously from the the rear end of the inner tube 12 to the interlocking slot 12*b* which is adapted to hold the cartridge 15 in the inner tube 12, whereby interlocking the protrusion 15*a* of the cartridge 15 surely but detachably with the inner tube 12.

Figure 7:
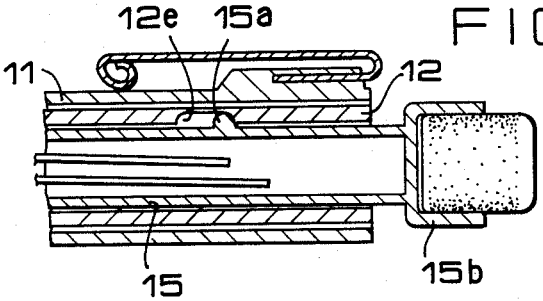
FIG. 7 is a fragmentary, longitudinal cross-sectional view of a mechanical pencil according to a still further embodiment of this invention.

FIG. 7 illustrates another embodiment of the interlocking means for the cartridge 15 and inner tube 12. In this embodiment, an interlocking groove or recess 12*e* is formed in the inner wall of the inner tube 12 so that the protrusion 15*a* of the cartridge 15 can be detachably received in the interlocking groove or recess 12*e*.

In the embodiment shown in FIG. 7, it is possible to form one or more slits through the circumferential wall of the cartridge 15 in the vicinity of the protrusion 15*a* so that the protrusion 15*a* may be bent radially to facilitate its sure engagement with the interlocking groove or recess 12*e*. By the way, the detachable interlocking between the cartridge 15 and inner tube 12 may be established, beside the above-mentioned embodiment, by the press-fitting or punching technique or by using other interlocking means.

Figure 8:
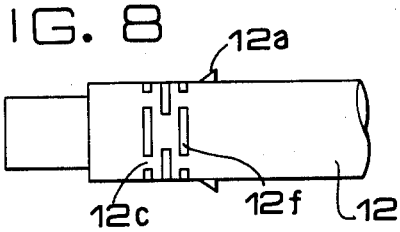
FIG. 8 is a fragmentary plan view of an inner tube.

As shown in FIGS. 6 and 8, the cushioning portion 12*c* defines a plurality of slits 12*f* capable of exhibiting writing pressure controlling effects. When an excessive writing pressure is exerted on the lead 16, the cushioning portion 12*c* is allowed to undergo axial contraction so that the lead 16 is retracted back into the decorative barrel 11. Provision of such slits can thus permit the omission of a second spring which normally biases the sleeve portion 12*d* of the inner tube 12 frontwards to impart a cushioning force to the inner tube 12, and moreover, can reduce the number of parts and hence simplify the assembly work significantly.

FIGS. 9–12 illustrate other embodiments of the cushioning portion 12*c* of the inner tube 12. The cushioning portion 12*c* may be formed into any shape so long as it can undergo deformations in accordance with writing pressures to be applied on the lead 16.

The control of the writing pressure by such a cushioning portion 12*c* is less linear than that available by virtue of contraction and expansion of a usual spring as shown in FIG. 13. Therefore, it can provide a small degree of cushioning effects even for a small writing pressure. A user of the mechanical pen can thus enjoy smooth and soft feeling as if he is writing with a gold pen.

In the above embodiment, the cushioning portion 12*c* is formed in the inner tube 12 in order to control the writing pressure. It should however be borne in mind that the cushioning portion 12*c* is not an essential element of the structure. Even if this cushioning portion 12C is not provided, the mechanical pencil can still be used as an ordinary mechanical pencil which has no writing pressure controlling function.

A lead guide 14 is fit in a rear end portion of a lead chuck 17 of the lead-feeding mechanism 13. This lead guide 14 serves to feed the writing leads 16 one by one to the lead chuck 17. Thus, the lead guide 14 defines internally a lead-feeding bore 14*a* which can feed only one lead 16 therethrough at once. The outer diameter of the rear end of the lead guide 14 is formed into substantially the same diameter as the inner diameter of the inner tube 12 so that none of the leads 16 is allowed to travel along the outer surface of the lead guide 14 toward the lead-feeding mechanism 13.

A rear end cap 15*b* is formed as an integral parts at the rear end of the cartridge 15. The cartridge 15 contains a number of writing leads 16. The cartridge 15 is usually sold together with refilling writing leads. The outer diameter of the cartridge 15 is formed into substantially the same diameter as the inner diameter of the inner tube 12. A lead-guiding tapered circumferential edge 15*c* is preferably formed aslant at a forward end portion of the cartridge 15. Furthermore, a protrusion 15*a* which engages with the interlocking slot 12*b* of the inner tube 12 is formed on a part of the outer surface of the cartridge 15.

The operation and effects of the mechanical pencil according to the above embodiment will next be described.

The lead-feeding mechanism 13, lead guide 14 and cartridge 15 are assembled in advance in the inner tube 12. Then, the sub-assembled inner tube 12 is placed within the decorative barrel 11 to complete the assembly of the mechanical pencil.

When the mechanical pencil has run out of writing leads in the course of its use, the cartridge 15 is withdrawn from the inner tube 12 by pulling the cartridge 15 out at the rear end cap 15*b*. Then, a fresh cartridge 15 containing leads 16 is pushed into the inner tube 12. The protrusion 15*a* of the cartridge 15 is thus brought into engagement with the interlocking slot 12*b* of the inner tube 12, thereby automatically interlocking the cartridge 15 and inner tube 12 together. Since the outer diameter of the cartridge 15 is substantially the same as the inner diameter of the inner tube 12, one or more leads 16 which may have been left over within the inner tube 12 can be smoothly received within the fresh cartridge 15 without breakage or blockage. Where the tapered circumferential edge 15*c* is formed at the forward end portion of the cartridge 15, such a remaining lead or leads 16 may be guided without failure into the cartridge 15 even if the lead or leads 16 lies or lie aslant in the inner tube 12. When the cartridge 15 is held in place as a lead-storing container in the inner tube 12, it also serves as an elongated, tubular, lead guide. It is thus possible to provide a mechanical pencil having a simple structure formed of an extremely small number of parts.

Where the cushioning portion 12*c* is formed integrally with the the inner tube 12 as illustrated in FIGS. 6, and 8–12, the cushioning portion 12*c* having a modulus of elasticity smaller than a lead-feeding spring 18, which gives cushioning effects, also serves as a writing pressure controlling spring. When an excessive writing pressure is exerted on the lead 16, the cushioning portion 12*c* is retracted toward the rear end of the inner tube 12 and the lead 16 is protected from breakage or the like. The cushioning portion 12*c* is formed integrally with the inner tube 12 as described above. This manner of formation of the cushioning portion 12*c* not only improves the efficiency of assembly work when assembling the inner tube 12 in the decorative barrel 11 but also makes a second spring, which may otherwise be incorporated to absorb excessive writing pressures, unnecessary. In other words, the cushioning portion 12*c* can reduce the number of parts and can thus cut the fabrication cost of each mechanical pencil.

As has been described above, the present invention has brought about extremely important practical effects. Namely, the mechanical pencil according to the present invention can be continuously used by simply replacing a used-up cartridge with a fresh cartridge containing a plurality of writing leads. Thus, it is unnecessary, different from conventional mechanical pencils, to insert a fresh supply of writing leads one by one into the mechanical pencil. Since a user is not required to touch writing leads directly, his hands are not smeared. Even if one or more previous leads are left over within the inner tube, they can be smoothly received within the fresh cartridge without breakage or blockage. The cartridge is directly interlocked with the inner tube, thereby reducing the number of parts and making the overall structure simpler. Where the cushioning portion is formed in the inner tube, the control of writing pressures can be surely effected without need for any extra cushioning spring.

What is claimed is:

1. A mechanical pencil comprising:

(a) a barrel to be held by a user;

(b) an inner sleeve removably held in place in said barrel;

(c) a lead-feeding mechanism separate from and contained within said inner sleeve;

(d) a lead guide abutting against said lead-feeding mechanism;

(e) a lead-containing cartridge having an outer diameter substantially equal to the inner diameter of one of said barrel or said inner sleeve and held detachably in said barrel;

wherein said barrel defines an interlocking slot therethrough, said inner sleeve has a projection on the outer surface thereof, and when assembled, said projection is brought into engagement with the interlocking slot so as to interlock said inner sleeve and said barrel together.

2. A mechanical pencil comprising:

(a) a barrel to be held by a user;

(b) an inner sleeve removably held in place in said barrel;

(c) a lead-feeding mechanism separate from and contained within said inner sleeve;

(d) a lead guide abutting against said lead-feeding mechanism;

(e) a lead-containing cartridge having an outer diameter substantially equal to the inner diameter of one of said barrel or said inner sleeve and held detachably in said barrel;

wherein said inner sleeve defines an interlocking slot therethrough, said cartridge has a protrusion on the outer surface thereof, and when assembled, said protrusion is detachably brought into engagement with said interlocking slot so as to interlock said inner sleeve and said cartridge together.

* * * * *